US005370929A

United States Patent [19]

Handa et al.

[11] Patent Number: 5,370,929

[45] Date of Patent: Dec. 6, 1994

[54] POLYESTER FIBER, PROCESS FOR THE PRODUCTION AND PROCESS FOR THE DYEING OF THE FIBROUS STRUCTURE OF THE POLYESTER FIBER

[75] Inventors: Nobuyoshi Handa; Yutaka Masuda, both of Otsu, Japan

[73] Assignee: Toray Industries, Inc., Japan

[21] Appl. No.: 5,909

[22] Filed: Jan. 15, 1993

[30] Foreign Application Priority Data

Jan. 20, 1992 [JP] Japan ..... 4-007541

[51] Int. Cl.[5] ..... D02G 3/00

[52] U.S. Cl. ..... 428/364; 528/308.1; 528/308.2; 528/308.4; 528/491; 528/499; 428/369; 428/401; 264/346; 264/DIG. 28

[58] Field of Search ..... 528/308.1, 308.2, 308.4, 528/499, 491; 428/364, 369, 401; 264/D28, 346

[56] References Cited

U.S. PATENT DOCUMENTS 4,426,516 1/1984 Kuriki et al. ..... 528/272

FOREIGN PATENT DOCUMENTS 0095712 12/1983 European Pat. Off. .
52-63292 5/1977 Japan .
53-35022 1/1978 Japan .
54-156861 11/1979 Japan .

OTHER PUBLICATIONS

Katayama, A., Senshoku Kogyo, vol. 24, No. 7, 1976, pp. 10–16.

Kuwabara, S., *Dyeing of Poly(Ethylene Terephthalate) Pre-Treated with Solvents,* Sen-I Gakkaishi, vol. 34, No. 9, 1978, pp. 56–64.

Wakida, T., *Dynamic Viscoelastic Property of Polyester Film Treated with Organic Solvent/Water,* Sen-I Gakkaishi, vol. 37, No. 5, 1981, pp. 33–37.

*Primary Examiner*—Samuel A. Acquah
*Attorney, Agent, or Firm*—Austin R. Miller

[57] ABSTRACT

A fiber of a polyester, in which 80% or more of the repeating units are composed of ethylene terephthalate, characterized in that it satisfies the following inequalities:

$$0.16 < \tan \delta_{max} < 0.22 \quad (1)$$

$$115 < T_{max} < 140 \quad (2)$$

$$D_{100} < -3.79 \times d^{\frac{1}{2}} + 91 \quad (3)$$

$$D_{130} > -11.36 \times d^{\frac{1}{2}} + 58 \quad (4)$$

as well as a process for the production and dyeing of a fibrous structure of the polyester fiber.

According to the present invention, especially in deep color dyeing at a high temperature, the degree of dye exhaustion is improved, and the utilization efficiency of the dye is enhanced, and moreover, especially in an extremely fine fiber yarn, a polyester fibrous structure having a concentration of a color shade equal to that of an ordinary yarn, which has never been obtained by the conventional process can be provided. In addition, there can be provided a polyester fiber and a fibrous structure thereof that are excellent in coloring properties and color fastness and can be used for various purposes.

4 Claims, No Drawings

POLYESTER FIBER, PROCESS FOR THE PRODUCTION AND PROCESS FOR THE DYEING OF THE FIBROUS STRUCTURE OF THE POLYESTER FIBER

BACKGROUND OF THE INVENTION

1. Field of the Invention

The present invention relates to a polyester fiber exhibiting excellent dyeing properties at a high temperature, although its normal pressure dyeability is low, and a process for the production as well as a process for the dyeing of the fibrous structure of the polyester fiber.

2. Description of the Related Art

A polyester fiber has a high refractive index among the various synthetic fibers, and is remarkably inferior to an acetate fiber in coloring properties, even when dyed with the same dye concentration. Since, in an extremely fine fiber of polyester, the surface area per a determined weight is increased, and irregular reflections of light (white light) on the fiber surface are increased, it has been said that a dyed product does not exhibit a high color value compared to an ordinary yarn, even if the same amount of dye is used. In order to obtain a dyed product having a deep color, a so-called "high concentration dyeing", becomes necessary in which a dye with a concentration 2 to 6 times as high as the dye concentration for an ordinary yarn is used.

The disadvantages of the high concentration dyeing are as follows:

(A) A large quantity of dye is required, and the utilization efficiency of the dye is lowered, resulting in high production costs.

(B) Many hours are required for dyeing or the cleaning of a dyeing machine.

(C) The fastnesses of a dyed product is lowered.

That is, there are many problems with respect to coloring properties, qualities, workability and production cost, and refinements in these problems are in demand.

With respect to refinement in the dyeability of a polyester fiber, examination of preliminary treatments of the polyester fiber with hot water and a solvent has been proposed by Kuwabara (Sen-i-gakkaishi [Journal of the Institute of Fibers], vol 34, No. 9, p. 56 (1978)), Wakita (Sen-i-gakkaishi, vol. 37, No- 5, p. 33 (1981)), and Katayama ("Senshoku Kogyo" [Dyeing Industry], vol. 24, No. 7, p. 10 (1976)).

In addition, as property modification of a material fiber for making the fiber dyeable under normal or atmospheric pressures, there have been proposed a process for the copolymerization of a polyalkylene glycol with a polyethylene terephthalate in, e.g., Japanese Unexamined Patent Publication No. 52-63292 and Japanese Unexamined Patent Publication No. 54-156861, and a process for the copolymerization of a polyalkylene glycol and isophthalic acid with a polyethylene terephthalate in Japanese Unexamined Patent Publication No. 53-35022.

Furthermore, as a process for spinning a polyethylene terephthalate at a high speed so as to obtain a fiber that is dyeable under normal pressures, there has been proposed, in Japanese Unexamined Patent Publication No. 57-161121, a normal pressure dyeable polyester fiber comprising a high speed spun polyethylene terephthalate fiber with a value of tan $\delta_{max}$ greater than 0,135 ($0,135 < \tan \delta_{max}$) and a value of $T_{max}$ (° C.) not higher than 105 ($T_{max}$ (° C.) $\leqq 105$) in a mechanical loss tangent tan δ-temperature T curve obtained by a measurement of dynamic viscoelasticity.

In the aforesaid Kuwabara's process, the preliminary treatment is effected at a temperature ranging from 106° C. and 135° C., and the dyeing is effected at a temperature of 105° C. at the highest, and in the aforesaid Wakita's process, the preliminary treatment is effected at a temperature of 140° C. at the highest, and the dyeing is effected at a temperature of 120° C. at the highest. However, a deep color-improving effect for a polyester fiber has not been sufficient according to any of these processes.

In other words, though the aforesaid hitherto known techniques are intended to improve the dyeing properties of a polyester at a low temperature, a notably high dyeability at a high temperature has not been obtained.

On the other hand, Katayama's process has been a process in which a dye is added to a water soluble high boiling medium and dyeing is effected at a high temperature. This process has, however, a defect in the sublimability of the dye and the dyeing fastnesses.

Also with respect to the aforesaid reforming process of a material fiber, when a polyalkylene glycol with a small repeating unit such as polyethylene glycol is copolymerized, the light exposure properties of the material fiber are likely to lower.

In addition, in the high speed spun fiber disclosed in Japanese Unexamined Patent Publication No. 57-161121, that is, a fiber with $T_{max}$ (° C.) $\leqq 105$, $T_{max}$ of the conventional drawn yarn for clothing within the range between 135 and 140° C., the packing density of a molecular chain belonging to an amorphous region is reduced owing to the lowering of the $T_{max}$ value and normal pressure dyeability has been obtained, but there is the problem in that the fiber is inferior in characteristics at a high ductility and has a high crystallization degree, which makes it difficult to control the degree of shrinkage and the like, and the utilization sphere of which is therefore narrow.

Accordingly, by the processes of the aforesaid prior art, though normal pressure dyeability may be imparted to a polyester fiber, there have been defects in that the dyeing properties of the fiber at a low temperature cannot be said to be sufficient, that the color fastness is lowered, or that certain properties, such as the mechanical properties of the polyester fiber, are degraded.

In addition, since dyeing of a polyester fiber is generally inferior in coloring properties, it is effected by increasing the concentration of the dye as a measure to counter this tendency. However, the utilization efficiency of the dye cannot be improved by such a measure, and therefore, there have been problems with respect to production costs, as well as drainage.

Further, although it has been recognized that when a polyester fiber is dyed at a temperature of 120° C. or more, adequate dyeing properties can be obtained, the present inventors' examination has proven that especially in the dyeing of an extremely fine fiber, improved dyeing properties become necessary to obtain a deep color.

The aforesaid techniques of improving dyeing properties have been insufficient.

SUMMARY OF THE INVENTION

The object of the present invention is, to provide a polyester fiber with high dyeability and a production process and dyeing process, without impairing the properties (mechanical properties, chemical resistance, and color fastnesses) of the polyester fibers, and to prevent the utilization efficiency of the dye from being lowered under high temperature dyeing conditions.

The present invention has the following constitution for the purpose of achieving the aforesaid object.

That is, the present invention relates to a fiber of a polyester, in which 80% or more of the repeating units are composed of ethylene terephthalate, characterized in that it satisfies the following inequalities (1) to (4).

$$0.16 < \tan \delta_{max} < 0.22 \quad (1)$$

$$115 < T_{max} < 140 \quad (2)$$

$$D_{100} < -3.79 \times d^{\frac{1}{2}} + 91 \quad (3)$$

$$D_{130} > -11.36 \times d^{\frac{1}{2}} + 58 \quad (4)$$

wherein tan $\delta_{max}$: a peak value in a mechanical loss tangent tan δ-temperature T curve obtained by a measurement of dynamic viscoelasticity;

$T_{max}$(° C.): a temperature at which tan δ in a mechanical loss tangent tan δ-temperature T curve obtained by a measurement of peak dynamic viscoelasticity;

$D_{100}$: dye exhaustion degree at 3% o.w.f. of Resolin Blue FBL at 100° C.;

$D_{130}$: dye exhaustion degree at 5% o.w.f. of Samaron GSL-400 at 130° C.; and d: monofilament denier.

The present invention further relates to a process for the production of a polyester fibrous structure, comprising subjecting a fibrous structure of a polyester, in which 80% or more of the repeating units are composed of ethylene terephthalate, to a heat treatment at a temperature of 160° C. or more with water or steam.

In addition, the present invention relates to a process for the production of a polyester fibrous structure comprising heat treating a fibrous structure of a polyester, in which 80% or more of the repeating units are composed of ethylene terephthalate, at a temperature of 160° C. or higher in a medium, that is diffusible in said polyester fiber but has little swelling effect, and subsequently subjecting the structure to a medium-eliminating treatment. Furthermore, the present invention relates to a process for the dyeing of a fibrous structure of a polyester, in which 80% or more of the repeating units are composed of ethylene terephthalate, comprising effecting the aforesaid treatment before dyeing the fibrous structure, and subjecting the fibrous structure to exhaustion dyeing at a dyeing temperature .ranging from 120° C. to 150° C.

DESCRIPTION OF THE PREFERRED EMBODIMENTS

In the following, the present invention will be explained in detail.

The present inventors have found that, since the excellent characteristics of a polyester fiber are degraded when normal pressure dyeability thereof is increased, by lowering the normal pressure dyeability, i.e., the dyeing properties at a low temperature, and by notably heightening the dyeability in high temperature dyeing, it becomes possible to make a polyester fiber deep colored without impairing the excellent properties of the polyester fiber, and the fiber becomes a polyester fiber with ideal high dyeability. Such a polyester fiber of high dyeability at a high temperature can be obtained by controlling the fiber structure by the preliminary treatment of a specific compound under specific conditions before the polyester fiber is preliminarily treated, as mentioned hereafter.

The present invention has succeeded in fixing a highly concentrated dye into the inside of a polyester fiber by subjecting the polyester fiber to a preliminary treatment under specific conditions (as mentioned hereafter, when a solvent other than water or steam is used, it is preferable to subject the polyester fiber to a medium-eliminating treatment after the preliminary treatment has been completed) as a result of careful examination of the interrelation among the preliminary treatment, the fibrous structure, the degree of fineness (d) and the dependence on dyeing temperature, and subsequently, preferably subjecting the preliminarily treated polyester fiber to high temperature exhaustion dyeing.

According to the present invention, there are advantages in that the utilization efficiency of the dye can be improved even in the case of high concentration dyeing, the amount of the dye used may be reduced as compared to the conventional process, and a dyed product excellent in fastnesses can be provided.

The polyester fiber of the present invention, having good dyeing properties at a high temperature, is formed by changing and controlling the fibrous structure by the hereinafter mentioned preliminary treatment, and it is presumed that the number of dyeing seats is increased in the state such that the structure of the amorphous portion that is to become a dyed portion of the dye does not become too loose, which is also supported by a measurement of the dynamic viscoelasticity of the fiber.

In the first place, a detailed explanation will be made of the polyester fiber of the present invention.

The requirements (1) and (2) for a high temperature -high dyeability polyester fiber referred to in the present invention will be explained.

$$0.16 < \tan \delta_{max} < 0.22 \quad (1)$$

$$115 < T_{max} < 140 \quad (2)$$

wherein tan $\delta_{max}$ indicates a peak value of tan δ in a mechanical loss tangent tan δ-temperature T curve obtained by a measurement of dynamic viscoelasticity, and $T_{max}$ (° C.) indicates a temperature at which tan δ reaches a peak value.

The value of tan δ referred to in the present invention can be obtained from a mechanical loss tangent Tan δ-temperature T curve obtained by a measurement of dynamic viscoelasticity. To be concrete, when this measurement is effected using Viblon ("DDV-II-EP produced by Orientech Co., Ltd.) and at a temperature rising rate of 3° C./min, the values of tan $\delta_{max}$ and $T_{max}$ are, respectively, within the ranges as defined by the inequalities, although the value of tan $\delta_{max}$ of the conventional polyethylene terephthalate fiber with a monofilament fineness ranging from 2 to 3 deniers for clothing is within the range between about 0.145 and about 0.150, and $T_{max}$ thereof is within the range between about 135° C. and about 140° C.

It has hitherto been said that the value of tan $\delta_{max}$ obtained by a measurement of dynamic viscoelasticity corresponds to the amorphous amount of the polyester fiber, while $T_{max}$ indicates the compactness or looseness (the weakness of the force of constraint of the polyester molecular chain) (see, e.g., Kamide et al., Senshoku Kogyo [Dyeing Industry], vol. 32, No. 7, p. 26, (1984)). The polyester fiber of the present invention has a tan $\delta_{max}$ value higher than an ordinary polyester fiber, and has a $T_{max}$ value ranging from a value equivalent to that of the ordinary polyester fiber to a value higher than that of the ordinary polyester fiber by 20° C.

That is, the above fact is presumed, with respect to the fibrous structure of the present invention, to indicate that the compactness of the amorphous region of the present fiber structure is not that different than the conventional polyester fiber, in relation to $T_{max}$, and the amount of the amorphous region of the present fibrous structure is increased compared to that of the conventional polyester fiber, in relation to tan $\delta_{max}$.

That is, the high temperature - high dyeability polyester fiber of the present invention is characterized in that it has an increased value of tan $\delta_{max}$ without noticeable lowering the value of $T_{max}$ as compared to the conventional ordinary polyester fiber.

Next, the requirements ③ and ④ of the high temperature - high dyeability polyester fiber referred to in the present invention will be explained:

$$D_{100} < -3.79 \times d^{\frac{1}{2}} + 91 \quad ③$$

$$D_{130} > -11.36 \times d^{\frac{1}{2}} + 58 \quad ④$$

wherein ③ indicates a degree of dye exhaustion of Resolin Blue FBL (hereinafter referred to as "FBL degree of exhaustion") when dyeing is effected by the use of 3% o.w.f. of Resolin Blue FBL at a bath ratio of 1:5 at 100° C. for 60 min, and 4 indicates a degree of dye exhaustion of Samaron Blue GSL-400 (hereinafter referred to as "GSL degree of exhaustion") when dyeing is effected by using 5% o.w.f. of Samaron Blue GSL-400 at a bath ratio of 1:20 at 130° C. for 60 min.

That is, the FBL degree of exhaustion is one of the parameters such that if one of these parameters is 85% or more in an ordinary yarn, this parameter indicates normal pressure dyeability of the ordinary yarn, when the ordinary yarn is dyed under the dyeing conditions as defined in ③ (refer to Senshoku Kogyo [Dyeing Industry], vol. 32, No. 7, p. 26, (1984)).

The GSL degree of exhaustion indicates a value approximate to the saturated dyed amount of Samaron Blue GSL-400 in the case of practical dyeing and also indicates dyeing properties in the case of high temperature dyeing.

In the present invention, although the dyeing properties vary depending on the fineness (d), when e.g., a fiber having a monofilament fineness of 2.5 deniers is used, this fiber is a high temperature - high dyeability polyester fiber with an FBL degree of exhaustion ($D_{100}$) smaller than 85% and a GSL degree of exhaustion ($D_{130}$) of 40% or more. The value of $D_{130}$ is preferably 50% or more.

The $D_{100}$ value of the conventionally used polyethylene terephthalate fiber (monofilament fineness: 2 to 3 deniers) is about 46% and the $D_{130}$ value is about 26%, and the $D_{100}$ value of an extremely fine yarn (single yarn fineness: 0.07 denier) is about 87% and the $D_{130}$ value thereof is about 47%.

On the other hand, a known normal pressure dyeable yarn, e.g., a copolymerized or high speed spun polyester fiber exhibits a $D_{100}$ value of 85% or more, which is out of the scope of the present invention. Such a polyester fiber with high low temperature dyeing properties do not always exhibit high dyeing properties at a high temperature; in many of such polyester fibers, the $D_{130}$ value is lower than 40%, and even in the case where $D_{130}$ exhibits a value of 40% or more, if low temperature dyeing properties are high, the dyeing fastnesses deteriorates, which is not preferable.

One of the features of the present invention is that $D_{100}$ is lower than a definite value, that is, the fiber is not normal pressure dyeable is presumed to correspond to the characteristic that the degree of looseness of the amorphous region in the fiber structure, and the feature that the $D_{130}$ value is large is presumed to correspond to some degree of the dyeing property of the fiber is high at a high temperature and high concentration, that is, the number of dyeing seats of the polyester fiber is increased.

The high temperature - high dyeing property fiber of the present invention has advantages in that it exhibits good dyeing properties to various kinds of disperse dyes, and it exhibits a degree of exhaustion 1.3 to 1.8 times as high as that of the conventional polyester fiber, for a deep color, and the color fastness is hardly lowered. The fiber of the present invention is effective for a fiber having an ordinary denier, and especially effective for an extremely fine fiber requiring an increased amount of a dye for the dyeing thereof, so that it becomes possible to express deep colors in a region that have never been attained.

The polyester fiber referred to in the present invention is a fiber of an ethylene terephthalate polymer in which 80% or more of the repeating units are composed of ethylene terephthalate, and as a polyester component, polyethylene terephthalate, polybutylene terephthalate, and various modified polymers thereof are included. At least 90% of the repeating units synthesized from a dicarboxylic acid with a high heat resistance and a diol are preferably composed of polyethylene terephthalate, though not particularly limited. The present polyester fiber is preferably of polyethylene terephthalate. In addition, an ordinary additive such as a delustering agent, flame retarder, and light resisting agent may be contained in the present polyester fiber.

Polyester fibers having a monofilament fineness of 20 deniers or less are used. The fiber that is preferably used in the present invention is a fiber having a monofilament fineness ranging preferably from 0.0001d to 1d, more preferably from 0.0001d to 0.5d, and most preferably from 0.0001d to 0.1d.

Such an extremely fine fiber as mentioned above may be a fiber produced by any process, generally, one produced of an islands-in-sea type composite fiber, one produced by direct spinning, one produced of a divided type composite fiber, or the like.

Examples of the fibrous structure of the present invention include yarn, loose fiber, fabric, non-woven fabric, sheet and the like, and the present fibrous structure is not particularly limited. This fibrous product may be a mixed product of a polyester fiber and other fibers.

In the following, the process for the production of high temperature - high dyeability polyester fibers of the present invention will be explained.

The production process of the present invention is a process in which a polyester fiber is subjected to a preliminary treatment at a temperature of 160° C. or higher using a gas or liquid diffusible in the polyester fiber, before dyeing the polyester fiber. When the treatment temperature is lower than 160° C., the high temperature -high dyeability fiber of the present invention cannot be obtained, and this temperature range is not preferable. The preliminary treatment temperature is preferably 180° C. or higher, and more preferably 190° C. or higher.

The treatment may be effected by optionally setting the treating time such that the aforesaid dynamic viscoelastic characteristic satisfies the requirements ① and ②.

As the preliminary treatment, a high temperature wet heat treatment with water or steam or a preliminary treatment using a water soluble hardly-swelling medium diffusible into a polyester fiber is preferably used.

As a high temperature wet heat treatment, preliminary treatments at a temperature ranging from 160° to 230° C., respectively, using high temperature steam, superheated steam and high temperature hot water may be considered.

As a preliminary treatment using a water soluble hardly-swelling medium diffusible in a polyester fiber, a preliminary treatment to be effected at a temperature ranging from 160° to 210° C. may be considered. In particular, when a water soluble high boiling solvent is used, the preliminary treatment can be effected under normal pressures.

A high temperature wet heat treatment using water or steam is preferable because it is a non-polluting process, but the cost is high because of the device for treatment thereof.

The water soluble hardly-swelling medium referred to in the present invention may be a medium that exhibits a solubility of 10% to water at room temperature and hardly exhibits a swelling capabability with respect to a polyester fiber at room temperature.

As the water soluble hardly-swelling medium, there may be mentioned, e.g., alcohol type mediums such as methanol, ethanol, propanol, and butanol; glycol type mediums such as ethylene glycol, diethylene glycol, triethylene glycol, propylene glycol, dipropylene glycol, tripropylene glycol, polypropylene glycol, polyethylene glycol, hexylene glycol, and glycerine; and diols such as 1,3-butanediol, and 1,4-butanediol.

Of the water soluble hardly-swelling mediums, those having a solubility parameter of 13.4 or more are preferable, and examples thereof are diethylene glycol, polyethylene glycol, propylene glycol, polypropylene glycol, hexylene glycol and the like. More preferably, mediums that have a high boiling point and a small molecular weight, i.e., polyethylene glycols or polypropylene glycols having a molecular weight of 300 or less, or the like may be considered. They can be used individually or as a blend of 2 or more and when the molecular weight of the medium is 600 or more, this medium is unlikely to be diffused into a polyester fiber.

The aforesaid mediums may be used individually, or as a blend of 2 or more, or as an aqueous solution thereof.

In addition, when a medium with a boiling point of 220° C. or lower, e.g., a low boiling medium such as water, methanol, ethanol, and ethylene glycol is used for the preliminary treatment, this treatment is effected under pressure, although the kind of the medium used varies depending upon the treating temperature. When effecting a treatment under pressure, water or steam is preferably used, and water is particularly preferable. When the treatment is effected under normal pressures, glycerine, diethylene glycol, triethylene glycol, polyethylene glycol, and propylene glycol are preferably used, and diethylene glycol, triethylene glycol, and propylene glycol are most preferably used. By using this treating method under normal pressures, very advantageous results with respect to productivity, equipment and production cost may be obtained.

When a swelling agent with a solubility parameter approximate to that of the polyester fiber (10.7) is used, many hours are required for a swelling agent-eliminating treatment owing to its considerably greater affinity for the fiber, and therefore, use of such a swelling agent is not preferable.

In the present invention, in order to obtain a high temperature - high dyeability, conditions that impart a sufficient change in fiber structure are required. According to the present inventor's examination, such a purpose can be achieved by the treatment under the aforesaid conditions, e.g., 160° C.×2 minutes or more, and a treatment of 5 minutes or more is more preferable. In the light of the shrinkage percentage of the fiber, it has been found that under the treatment conditions such that the shrinkage percentage of an ordinary polyethylene terephthalate oriented yarn (shrinkage in boiling water: 9%; monofilament fineness: 2 to 3d) becomes 13% or more, a change in fibrous structure occurs, which is enough to exhibit the effect of the present invention. The fiber or fabric to be herein treated is not always required to be treated to have the above shrinkage percentage, and a sufficient effect has been recognized by the treatment under tension or under a determined length.

Such treating conditions are preferably selected by synthetic judgement of not only the fixing rate and color development of the dye but by hand (shrinkage percentage), fiber strength and the like.

Although the high temperature wet heat treatment and treatment by using a water soluble hardly-swelling medium according to the present invention is effected most preferably under no tension, its effects are sufficiently exhibited even by a treatment under tension.

In the treatment using water or steam, a medium-eliminating treatment is not particularly required, but after a treatment using a water soluble hardly-swelling medium has been effected, it is preferable to effect a treatment for eliminating the medium. When the water soluble hardly-swelling medium remains in the polyester fiber, the solubility of the disperse dye becomes higher than required, thereby resulting in a noticeable lowering of the fixability of the dye, or discoloration of fabric. Therefore, it is preferable to eliminate the medium to the greatest possible extent.

It is presumed that in the polyester fiber that has been subjected to the aforesaid treatment, there is formed a fiber structure that is likely to absorb the dye, and the formed fiber structure is apt to be easily broken by again being subjected to a heat treatment (high temperature heat treatment) and a return to the original state of the fiber before it is subjected to the preliminary treatment. Accordingly, since the dyeability of the fiber is likely to be lowered owing to the second heat treatment followed by the preliminary treatment, it is preferable to maintain a fiber structure capable of easily absorbing the dye and transferring the fiber having the thus maintained fiber structure into the subsequent dyeing step. For this purpose, it is preferable to eliminate the medium at a relatively low temperature in the medium-eliminating treatment. The condition of such a medium elimination is washing of the fiber with water or a solvent at a temperature of 160° C. or lower, or treatment of the fiber with hot air at a temperature of 160° C. or lower, and also in the subsequent drying step, treatment of the fiber at a temperature of 160° C. or lower, preferably 130° C. or lower, constitutes a preferable condition for obtaining high dyeability.

In the present invention, the amount of such a remaining medium is controlled to preferably 5 wt-% or less, more preferably to 2 wt-% or less.

By dyeing the thus obtained fiber at a high temperature, it is possible to apply the dye to the fiber by using the high fixability and high efficiency of the dye and thereby provide a colored fibrous structure having sufficient fastness, though it has high coloring properties.

Subsequently, the fiber is transferred to a dyeing step followed by a medium-eliminating treatment. (When the fiber is to be subjected to a preliminary treatment with steam or water, the fiber is transferred to a dyeing step after the preliminary treatment has been completed, without effecting a medium-eliminating treatment.) As the dye, a disperse dye that has widely been used for a polyester fiber is used.

As the dyeing method, any, e.g., continuous bath dyeing, printing, and exhaustion dyeing may be used, but the exhaustion dyeing method is most preferably used. In the exhaustion dyeing method, the dyeing is effected preferably at a temperature ranging from 120° C. to 150° C., more preferably from 130° C. to 140° C.

In the present invention, there is adopted a temperature under which the dye is easily absorbed in the fiber and the fiber structure changes, and the fiber is subjected to a medium-eliminating treatment, while such a temperature is maintained, whereafter the greatest possible amount of the dye is absorbed into the fiber by an ordinary high temperature dyeing, so as to fix the dye to the fiber. This dyeing at a high temperature is considered to excite both the exhaustion of the dye and a change in the fiber structure (a change in the fiber to return to the original state before the preliminary treatment). In addition, if, when effecting the medium-eliminating treatment, the treating temperature is excessively high, the fiber structure becomes similar to the original state before the preliminary treatment, it is likely that improvement of the fixability of the dye cannot be expected. That is, it is considered that the present invention has the function of securely fixing a large quantity of a dye by exhausting the dye into the fiber, and returning the fiber to the original fiber structure while the dye-exhausted state is being retained, during a high temperature dyeing, and consequently, the obtained dyed product attains an excellent color fastness.

According to the present invention, the utilization efficiency of the dye can be improved even in a high concentration dyeing, and the amount of dye used can be reduced compared to the conventional method, and a dyed product with excellent various fastness characteristics can be provided.

By the present invention, a colored fibrous structure having sufficient fastnesses and high coloring properties can be provided, by exhausting the dye to a polyester fiber by making the fiber highly fixable and highly utilizable, and when an extremely fine fiber is used, the coloring properties are very low compared to an ordinary yarn, even at the same dye concentration, and therefore, an extremely fine fiber is dyed with a dye of an amount 2 to 6 times higher than when an ordinary yarn is to be dyed, so that the effect of the present invention is very significant.

In addition, the deeper the color of a dyed product to be obtained, the more the true merit of the present invention is proven. For example, deep color dyeing, in which the dye concentration (by the standard of 100% in the case of a commercially available dye) of preferably 2 wt-% or more, more preferably 3 wt-% or more is applied to a fabric, can be stably achieved with good reproducibility. Furthermore, when the same color concentration is to be obtained, the color fastness is improved in the dyed product obtained in the present invention, compared to the dyed product obtained by the conventional method.

In addition, after the dyeing has been completed, the dyed product may be subjected to an ordinary soaping step, if necessary.

The present invention will be explained in more detail with reference to the following non-limitative working examples.

EXAMPLES 1 TO 14, AND COMPARATIVE EXAMPLES 1 to 5

As a fabric composed of a regular yarn (ordinary yarn), a fabric (taffeta) was used, the warp and weft of which were, respectively, polyethylene terephthalate fiber (150 deniers-48 filaments), which had been scored and heat set (Examples 1, 3, 5, 7, 9, 11).

In addition, as an extremely fine yarn, a fabric composed of an extremely fine fiber with a monofilament fineness of 0.07 denier was used and was obtained by subjecting a fabric (taffeta) of a 50 deniers-9 filaments yarn) consisting of a polyethylene terephthalate copolymerized with 4 mol-% of 5-sodium sulfoisophthalic acid as a sea component and a polyethylene terephthalate as an island component (70 islands per filament; the ratio of sea to islands: 10:90) to a treatment with an alkali (Examples 2, 4, 6, 8, 10, and 12).

These fabrics were, respectively, subjected to a preliminary treatment under the conditions set forth in Table 1. The preliminary treatment using high temperature hot water (Examples 5 to 8) and that using a high boiling water soluble solvent (Examples 9 to 12) were, respectively, effected by immersion of the fabrics. In addition, as the high boiling water soluble solvent, a polyethylene glycol (PEG) with a molecular weight of 200 was used, and after the preliminary treatment had been completed, the fabrics were washed with water, again washed with hot water at 80° C., and dried for 3 minutes at a temperature of 100° C. (Examples 9 to 12).

After the preliminary treatments had been completed, the fabrics were dyed under the following conditions, and subsequently subjected to ordinary reduction cleaning (80° C.), following which the thus treated fabrics were again washed with water and washed with hot water at a temperature of 60° C., whereafter the washed fabrics were dried for 3 minutes at a temperature 100° C. With respect to the thus treated fabrics, dynamic viscoelastic characteristics (tan $\delta_{max}$, $T_{max}$), and degrees of dye exhaustion ($D_{100}$, $D_{130}$) were obtained using the following methods. The results are also set forth in Table 1.

tan $\delta_{max}$, $T_{max}$

Using "Viblon" (DDV-11-EP produced by Orientech Co., Ltd.) and at a temperature elevating rate of 3° C./min, a mechanical loss tangent tan δ-temperature T curve was measured and obtained. With respect to an ordinary yarn, a yarn of 150 deniers was subjected to the measuring, and with respect to the extremely fine yarn, the yarns decomposed from a fabric were gathered to form a yarn of 150 deniers, which was then subjected to a measuring. The values in the parenthesis are the results obtained after dyeing.

$D_{100}$

Using 3% o.w.f. of Resolin Blue FBL (C.I.Disperse Blue 56) (produced by Bayer A.G.; disperse dye), dyeing was effected for 60 minutes at a bath ratio of 1:50, and at a temperature of 100° C.

With respect to exhaustion percentage, the remaining liquid was collected and dissolved in an acetone/water (1:1) solution, and the degree of dye exhaustion ($D_{100}$) was evaluated by applying a calorimetric method to the remaining liquid.

$D_{130}$

Using 5% o.w.f. of Samaron Blue GSL-400 (C.I.Disperse Blue 165) (produced by Hoechst GmbH; disperse dye), dyeing was effected for 60 minutes at a bath ratio of 1:20 and at a temperature of 130° C.

With respect to the degree of exhaustion of GSL, the dyed fabric was dissolved by a solution of phenol/ethane tetrachloride (6:4), and a calibration curve was obtained by the dissolution calorimetric method, and from the graph thus obtained, a degree of dye exhaustion ($D_{130}$) was evaluated.

Shrinkage Percentage (ordinary yarn alone)

As one of the indices estimating the conditions of the preliminary treatment, the shrinkage percentage was obtained using the following method.

With respect to shrinkage percentage, using as a yarn an ordinary polyethylene terephthalate yarn (48 filaments of 150 deniers) having a boiled water shrinkage percentage of about 9%, this yarn was treated under no tension at a preliminary treatment temperature and time with hot water under each condition. Yarn lengths before and after the treatment were measured under a load of 0.1 g/d (15 g), so as to obtain a shrinkage percentage.

With respect to the dyed fabrics, color fastnesses were evaluated according to JIS L0844 (color fastness to washing) and JIS L0849 (color fastness to rubbing), and the results were also set forth in Table 1.

In addition, in order to evaluate the coloring properties, L* values were obtained a multiilluminant spectrophotometric colorimeter (produced by Suga Test Machine Co., Ltd.). The results were set also forth in Table 1. The L* values indicate that the smaller the value, the higher the color value.

On the other hand, for comparison, the results of the evaluation of characteristics were set forth in Table 1 also with respect to the case where no preliminary treatment was effected (Comparative Examples 1 and 2) and the case where a treatment with high temperature hot water at 130° C. was effected (Comparative Examples 3 and 4).

Furthermore, evaluations were also made with respect to a fabric (taffeta) composed of a copolymerized polyethylene terephthalate yarn (48 filaments of 150 deniers) obtained by copolymerizing 7.5 wt-% of polyethylene glycol as a conventional normal pressure dyeable yarn, and the obtained results were set forth in Table 1 (Comparative Example 5).

As may be clearly seen from Table 1, the yarns according to the present invention (Examples 1 to 12) exhibited a low degree of dye exhaustion ($D_{100}$) in the case of low temperature dyeing, while they exhibited a high degree of dye exhaustion ($D_{130}$) in the case of high temperature dyeing (satisfying the aforesaid requirements ③ and ④), high color fastness, and were excellent in coloring properties.

In contrast, in Comparative Examples 1 and 3, the dyeing properties at a high temperature and a low temperature were low (not satisfying the aforesaid requirement ④), and the coloring properties were inferior.

In addition, when an extremely fine yarn was used, the dyeing properties at a high temperature were low as shown in Comparative Examples 2 and 4 (not satisfying the aforesaid requirement ④), and the coloring properties especially were inferior, which shows that the effect of the present invention is noticeable.

Further, the normal pressure dyeable yarn in Comparative Example 5 exhibited a very high degree of dye exhaustion at a low temperature (not satisfying aforesaid requirement ③), and was inferior in color fastness.

EXAMPLES 13 TO 18 AND COMPARATIVE EXAMPLES 6 TO 11

Using the same ordinary yarn and extremely fine yarn as in Examples 1 and 2, a preliminary treatment was effected for 2 minutes at a temperature of 180° C. using hexylene glycol, and these yarns were washed with water in the same manner as in Example 11, washed with hot water at a temperature of 80° C., and dried for 3 minutes at a temperate of 100° C. Dyeing was effected with each of the dyes set forth in Table 2 for 60 minutes (bath ratio: 1:20) at a dye concentration of 20% o.w.f. Subsequently, the dyed products were subjected to ordinary reduction cleaning, washed with water, washed with hot water at a temperature of 60° C., and dried for 3 minutes at a temperature of 100° C. L* values of the obtained fabrics were determined, and the results were set forth also in Table 2. Comparative Examples 6 to 11 are the examples where no preliminary treatment was effected.

As may be clearly seen from Table 2, it can be understood that the fibrous structures obtained by the dyeing method according to the present invention (Examples 13 to 18) are singnificantly high in coloring properties in any of the dyes, compared to the comparative examples.

EXAMPLES 19 TO 24, AND COMPARATIVE EXAMPLES 12 AND 13

Using the same ordinary yarn as in Example 1, a preliminary treatment was effected using diethylene glycol or triethylene glycol for 2 minutes at a temperature ranging from 130° to 200° C. as shown in Table 3, and the dyed product was washed with water, washed with hot water, and dried in the same manner as in Example 11. Dyeing was effected using 5% o.w.f. of Samaron Blue GSL-400 (produced by Hoechst GmbH) for 60 minutes at a temperature of 130° C. (bath ratio: 1:20), and the dyed product was subsequently subjected to ordinary reduction washing at a temperature of 80° C., whereafter it was washed with water, washed with hot water at a temperature of 60° C., and dried for 3 minutes at a temperature of 100° C. L* values of the obtained fabrics were determined, and the results were set forth also in Table 3.

As is clear from Table 3, it may be seen that the fibrous structures obtained by the dyeing method according to the present invention (Examples 19 to 24) have a high L* value, and exhibit significantly high coloring properties. In contrast, when the treatment temperature was 130° C. (Comparative Examples 12 and 13), the fibrous structures were inferior in coloring properties.

In addition, the fibrous products obtained by the dyeing method according to the present invention exhibited color fastness equal to that of the fibrous product that had not been subjected to a preliminary treatment (Comparative Example 1); this color fastness being excellent.

According to the present invention, especially in deep color dyeing, the degree of dye exhaustion is improved, and utilization efficiency of the dye is enhanced, and moreover, especially when an extremely fine yarn is used, a polyester fibrous structure with a concentration of a color shade equal to that of an ordinary yarn can be provided, which has never been obtained by the conventional method. In addition, a polyester fiber and a fibrous structure thereof, that are excellent in coloring properties and color fastness that may be used for various purposes can be obtained.

TABLE 1

| | Preliminary treatment | Monofilament fineness (d) | Dynamic viscoelastic characteristics: tan $\delta_{max}$ | Dynamic viscoelastic characteristics: $T_{max}$ (°C.) | Degree of exhaustion of dye (%): $D_{100}$ | Degree of exhaustion of dye (%): $D_{130}$ |
|---|---|---|---|---|---|---|
| Ex. 1 | high temperature steam 200° C., 2 min. | 3.1 | 0.176 (0.194) | 130 (122) | 57.1 | 58.5 |
| Ex. 2 | high temperature steam 200° C., 2 min. | 0.07 | 0.180 | 135 | 81.1 | 65.1 |
| Ex. 3 | superheated steam 220° C., 2 min | 3.1 | 0.170 | 133 | 56.2 | 56.2 |
| Ex. 4 | superheated steam 220° C., 2 min | 0.07 | 0.175 | 130 | 75.6 | 68.4 |
| Ex. 5 | high temperature hot water 160° C., 2 min | 3.1 | 0.165 | 131 | 51.8 | 51.9 |
| Ex. 6 | high temperature hot water 160° C., 2 min | 0.07 | 0.170 | 135 | 81.5 | 56.3 |
| Ex. 7 | high temperature hot water 190° C., 2 min | 3.1 | 0.174 (0.192) | 133 (124) | 59.1 | 53.7 |
| Ex.8 | high temperature hot water 190° C., 2 min | 0.07 | 0.178 | 134 | 84.7 | 63.4 |
| Ex. 9 | water soluble hardly-swelling medium 160° C., 2 min | 3.1 | 0.160 | 137 | 57.2 | 51.8 |
| Ex. 10 | water soluble hardly-swelling medium 160° C., 2 min | 0.07 | 0.170 | 135 | 83.5 | 57.7 |
| Ex. 11 | water soluble hardly-swelling medium 190° C., 2 min | 3.1 | 0.164 (0.212) | 139 (118) | 78.7 | 77.5 |
| Ex. 12 | water soluble hardly-swelling medium 190° C., 2 min | 0.07 | 0.190 | 127 | 81.9 | 73.2 |
| C.E. 1 | no | 3.1 | 0.147 (0.158) | 139 (135) | 45.7 | 25.3 |
| C.E. 2 | no | 0.07 | 0.159 | 138 | 86.8 | 47.2 |
| C.E. 3 | no | 3.1 | 0.148 | 138 | 46.0 | 26.0 |
| C.E. 4 | no | 0.07 | 0.160 | 137 | 87.0 | 47.5 |
| C.E. 5 | no | 3.1 | 0.133 | 103 | 96.9 | 39.6 |

TABLE 1-continued

| | Color Fastness (grade): washing: staining | Color Fastness (grade): washing: change in color | Color Fastness (grade): rubbing: dry | Color Fastness (grade): rubbing: wet | Coloring properties (L* value) | Shrinkage percentage (%) |
|---|---|---|---|---|---|---|
| Ex. 1 | 4 | 4–5 | 4–5 | 4–5 | 22.5 | 23.6 |
| Ex. 2 | 4 | 4–5 | 4–5 | 4–5 | 23.5 | |
| Ex. 3 | 4 | 4–5 | 4–5 | 4–5 | 23.1 | 18.0 |
| Ex. 4 | 4 | 4–5 | 4–5 | 4–5 | 27.5 | |
| Ex. 5 | 4 | 4–5 | 4–5 | 4–5 | 24.2 | 13.1 |
| Ex. 6 | 4 | 4–5 | 4–5 | 4–5 | 24.0 | |
| Ex. 7 | 4 | 4–5 | 4–5 | 4–5 | 23.1 | 16.1 |
| Ex. 8 | 4 | 4–5 | 4–5 | 4–5 | 24.8 | |
| Ex. 9 | 4 | 4–5 | 4–5 | 4–5 | 24.1 | 13.0 |
| Ex. 10 | 4 | 4–5 | 4–5 | 4–5 | 23.1 | |
| Ex. 11 | 4 | 4–5 | 4–5 | 4–5 | 21.0 | 22.6 |
| Ex. 12 | 4 | 4–5 | 4–5 | 4–5 | 23.0 | |
| C.E. 1 | 4 | 4–5 | 4–5 | 4–5 | 26.8 | 9.0 |
| C.E. 2 | 4 | 4–5 | 4–5 | 4–5 | 32.1 | |
| C.E. 3 | 4 | 4–5 | 4–5 | 4–5 | 26.1 | 11.0 |
| C.E. 4 | 4 | 4–5 | 4–5 | 4–5 | 31.2 | |
| C.E. 5 | 3 | 4–5 | 4 | 4 | 26.0 | |

Ex. = Example, C.E. = Comparative Example

TABLE 2

| | Dye | Preliminary treatment | Monofilament fineness (d) | Coloring properties (L* value) |
|---|---|---|---|---|
| Ex. 13 | C.I. Disperse Red 279 | hexylene glycol 180° C., 2 min | 3.1 | 32.9 |
| C.E. 6 | C.I. Disperse Red 279 | no | 3.1 | 38.1 |
| Ex. 14 | C.I. Disperse Red 279 | hexylene glycol 180° C., 2 min | 0.07 | 34.3 |
| C.E. 7 | C.I. Disperse Red 279 | no | 0.07 | 39.3 |
| Ex. 15 | Palanil Blue 2 G produced by BASF) | hexylene glycol 180° C., 2 min | 3.1 | 21.1 |
| C.E. 8 | Palanil Blue 2 G produced by BASF) | no | 3.1 | 24.9 |
| Ex. 16 | Palanil Blue 2 G produced by BASF) | hexylene glycol 180° C., 2 min | 0.07 | 19.1 |
| C.E. 9 | Palanil Blue 2 G produced by BASF) | no | 0.07 | 23.9 |
| Ex. 17 | C.I. Disperse Red 167 | hexylene glycol 180° C., 2 min | 3.1 | 25.1 |
| C.E. 10 | C.I. Disperse Red 167 | no | 3.1 | 29.8 |
| Ex. 18 | C.I. Disperse Red 167 | hexylene glycol 180° C., 2 min | 0.07 | 25.3 |
| C.E. 11 | C.I. Disperse Red 167 | no | 0.07 | 29.2 |

Ex. = Example, C.E. = Comparative Example

TABLE 3

| | Preliminary treatment | Monofilament fineness (d) | Coloring properties (L* value) | Shrinkage percentage (%) |
|---|---|---|---|---|
| C.E. 12 | diethylene glycol 130° C., 2 min | 3.1 | 26.1 | 7.8 |
| C.E. 13 | triethylene glycol 130° C., 2 min | 3.1 | 26.2 | 8.5 |
| Ex. 19 | diethylene glycol 160° C., 2 min | 3.1 | 24.0 | 16.5 |
| Ex. 20 | triethylene | 3.1 | 24.1 | 16.6 |

TABLE 3-continued

| | Preliminary treatment | Monofilament fineness (d) | Coloring properties (L* value) | Shrinkage percentage (%) |
|---|---|---|---|---|
| | glycol 160° C., 2 min | | | |
| Ex. 21 | diethylene glycol 180° C., 2 min | 3.1 | 22.2 | 20.3 |
| Ex. 22 | triethylene glycol 180° C., 2 min | 3.1 | 21.9 | 18.1 |
| Ex. 23 | diethylene glycol 200° C., 2 min | 3.1 | 20.6 | 32.0 |
| Ex. 24 | triethylene glycol 200° C., 2 min | 3.1 | 20.6 | 30.9 |

Ex. = Example, C.E. = Comparative Example

We claim:

1. A fiber of a polyester, in which 80% or more of the repeating units are composed of ethylene terephthalate, characterized in that it satisfies the following inequalities.

$$0.16 < \tan \delta_{max} < 0.22 \quad (1)$$

$$115 < T_{max} < 140 \quad (2)$$

$$D_{100} < -3.79 \times d^{\frac{1}{2}} + 91 \quad (3)$$

$$D_{130} > -11.36 \times d^{\frac{1}{2}} + 58 \quad (4)$$

wherein $\tan \delta_{max}$: a peak value of tan δ in the mechanical loss tangent tan δ-temperature T curve obtained by a measurement of dynamic viscoelasticity;

$T_{max}$ (° C.): a temperature at which tan δ in the mechanical loss tangent tan δ-temperature T curve obtained by the measurement of dynamic viscoelasticity reaches the peak value;

$D_{100}$: degree of exhaustion of dye of Resolin Blue FBL at a concentration of 3% o.w.f. at 100° C.;

$d_{130}$: degree of dye exhaustion of Samaron Blue GSL-400 at a concentration of 5% o.w.f. at 130° C.; and d: monofilament denier 2. A polyester fiber according to claim 1, wherein the monofilament fineness of the polyester fiber is not more than 1 denier.

3. A process for the production of a polyester fibrous structure, comprising subjecting a fibrous structure of a polyester, in which 80% or more of the repeating units are composed of ethylene terephthalate, to a heat treatment at a temperature of 160° C. or higher with water or steam.

4. A process according to claim 3, wherein the polyester fibrous structure contains an extremely fine fiber with monofilament fineness of not more than 1 denier.

* * * * *